US010777942B2

(12) United States Patent
Huang

(10) Patent No.: US 10,777,942 B2
(45) Date of Patent: Sep. 15, 2020

(54) SIGNAL TRANSMISSION CABLE

(71) Applicant: ASUSTeK COMPUTER INC., Taipei (TW)

(72) Inventor: Shih-Nien Huang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/429,235

(22) Filed: Jun. 3, 2019

(65) Prior Publication Data

US 2019/0393653 A1 Dec. 26, 2019

(30) Foreign Application Priority Data

Jun. 22, 2018 (TW) ..... 1071215 81 A

(51) Int. Cl.

| | |
|---|---|
| ***H01R 13/6592*** | (2011.01) |
| ***H01R 13/6581*** | (2011.01) |
| ***H01B 7/17*** | (2006.01) |
| ***H01B 11/10*** | (2006.01) |
| ***H01B 13/22*** | (2006.01) |
| ***H01B 11/18*** | (2006.01) |

(52) U.S. Cl.

CPC ..... *H01R 13/6592* (2013.01); *H01B 7/17* (2013.01); *H01B 11/10* (2013.01); *H01B 11/1821* (2013.01); *H01B 13/22* (2013.01); *H01R 13/6581* (2013.01)

(58) Field of Classification Search

CPC ..... H01R 9/0512; H01R 13/6592; H01R 13/6593; H01R 12/53; H01B 7/226; H01B 11/1821; H01B 11/1025

See application file for complete search history.

(56) References Cited

U.S. PATENT DOCUMENTS

| | | | | |
|---|---|---|---|---|
| 7,323,640 | B2 | 1/2008 | Takahashi et al. | |
| 9,385,478 | B2 * | 7/2016 | Kim | H02G 15/08 |
| 2011/0253415 | A1 * | 10/2011 | Muschiatti | H01B 11/1821 174/107 |

FOREIGN PATENT DOCUMENTS

| | | | |
|---|---|---|---|
| CN | 106340924 | A | 1/2017 |
| TW | 200402070 | A | 2/2004 |
| TW | M487513 | U | 10/2014 |

* cited by examiner

*Primary Examiner* — Nguyen Tran
*Assistant Examiner* — Paul D Baillargeon
(74) *Attorney, Agent, or Firm* — McClure, Qualey & Rodack, LLP

(57) ABSTRACT

A signal transmission cable includes a first connector, a signal line, a first shielding line, and a second shielding line. The signal line is electrically connected to the first connector. The first shielding line is electrically connected to the first connector, extending away from the first connector, and wound around at least a portion of the signal line along a first rotating direction. The second shielding line is electrically connected to the first connector, extending away from the first connector, and wound around at least a portion of the signal line along a second rotating direction.

9 Claims, 5 Drawing Sheets

B-B

SIGNAL TRANSMISSION CABLE

CROSS-REFERENCE TO RELATED APPLICATION

This application claims the priority benefit of Taiwan Application Serial No. 107121581, filed on Jun. 22, 2018. The entirety of the above-mentioned patent application is hereby incorporated by reference herein and made a part of the specification.

BACKGROUND OF THE INVENTION

Field of the Invention

The disclosure relates to a signal transmission cable.

Description of the Related Art

Currently, a differential signal line has a first connecting part which is connecting with a mother board and a USB connector and a second connecting part which is connecting with the USB connector and a cable, and the first connecting part and the second connecting part jointly generate the common mode current on the surfaces of the USB connector and the cable due to impedance and grounding discontinuity of reference signals is excited, thereby causing the problem of common mode noise radiation interference at the frequency of 2.5 GHz.

BRIEF SUMMARY OF THE INVENTION

According to an aspect of the disclosure, a signal transmission cable is provided herein. The signal transmission cable comprises: a first connector; a signal line, electrically connected to the first connector; a first shielding line, electrically connected to the first connector, extending away from the first connector and wound around at least a portion of the signal line along a first rotating direction; and a second shielding line, electrically connected to the first connector, the second shielding line extends away from the first connector and winds around at least a portion of the signal line along a second rotating direction.

According to the above-mentioned structural configuration, because the first shielding line and the second shielding line of the disclosure are two spiral parts with opposite rotating directions and together form a double-spiral structure, the electromagnetic radiation generated by the common mode current flowing in the first shielding line and the second shielding line substantially eliminates each other. Therefore, the signal transmission cable of this embodiment reduces the electromagnetic wave interference caused by the common mode current generated on the shielding surface of the cable, thereby improving the sensitivity and signal throughput of a radio frequency component in an electronic device.

DETAILED DESCRIPTION OF THE EMBODIMENTS

Figure 1:
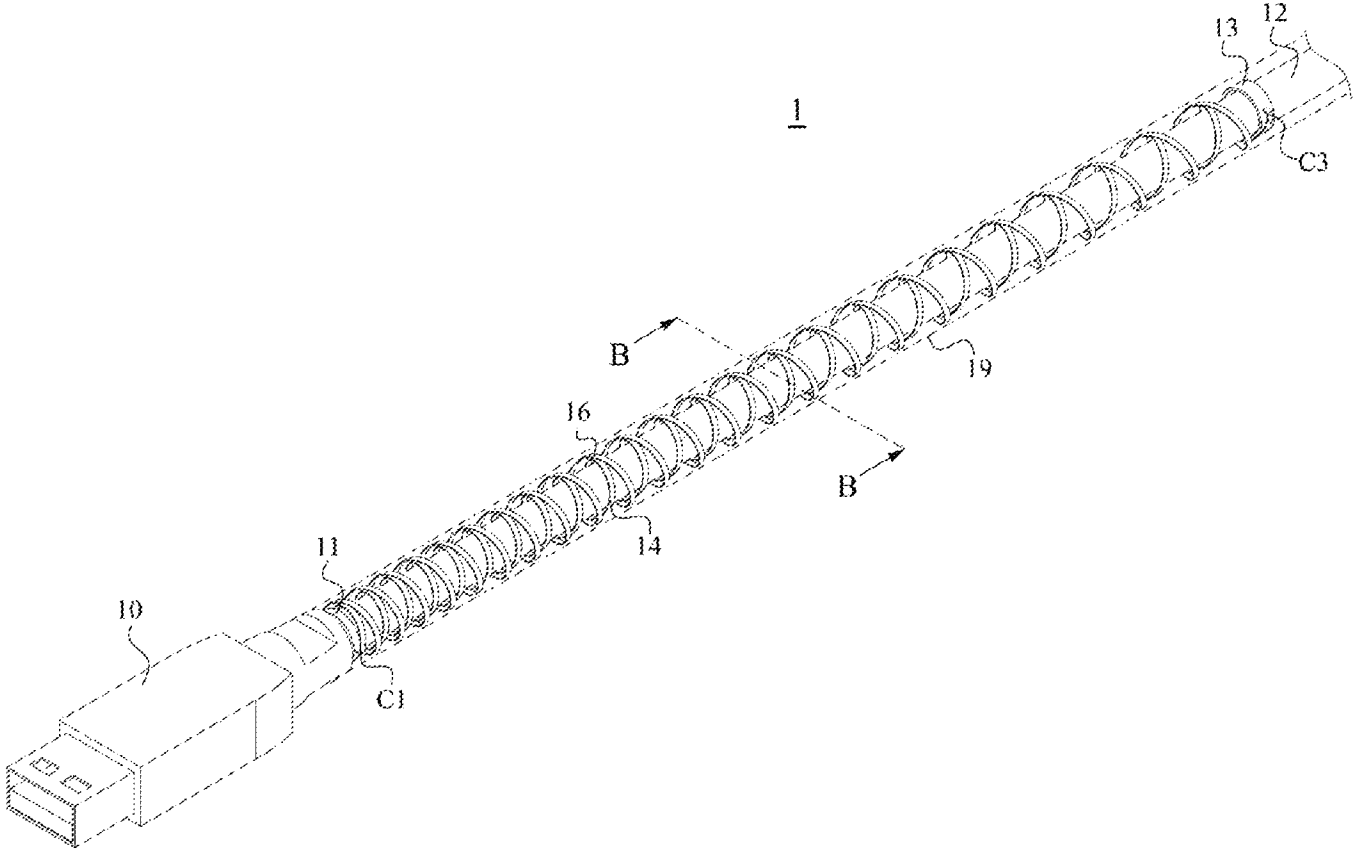
FIG. 1 is a partial three-dimensional view showing a signal transmission cable according to an embodiment of the disclosure.
Figure 2A:
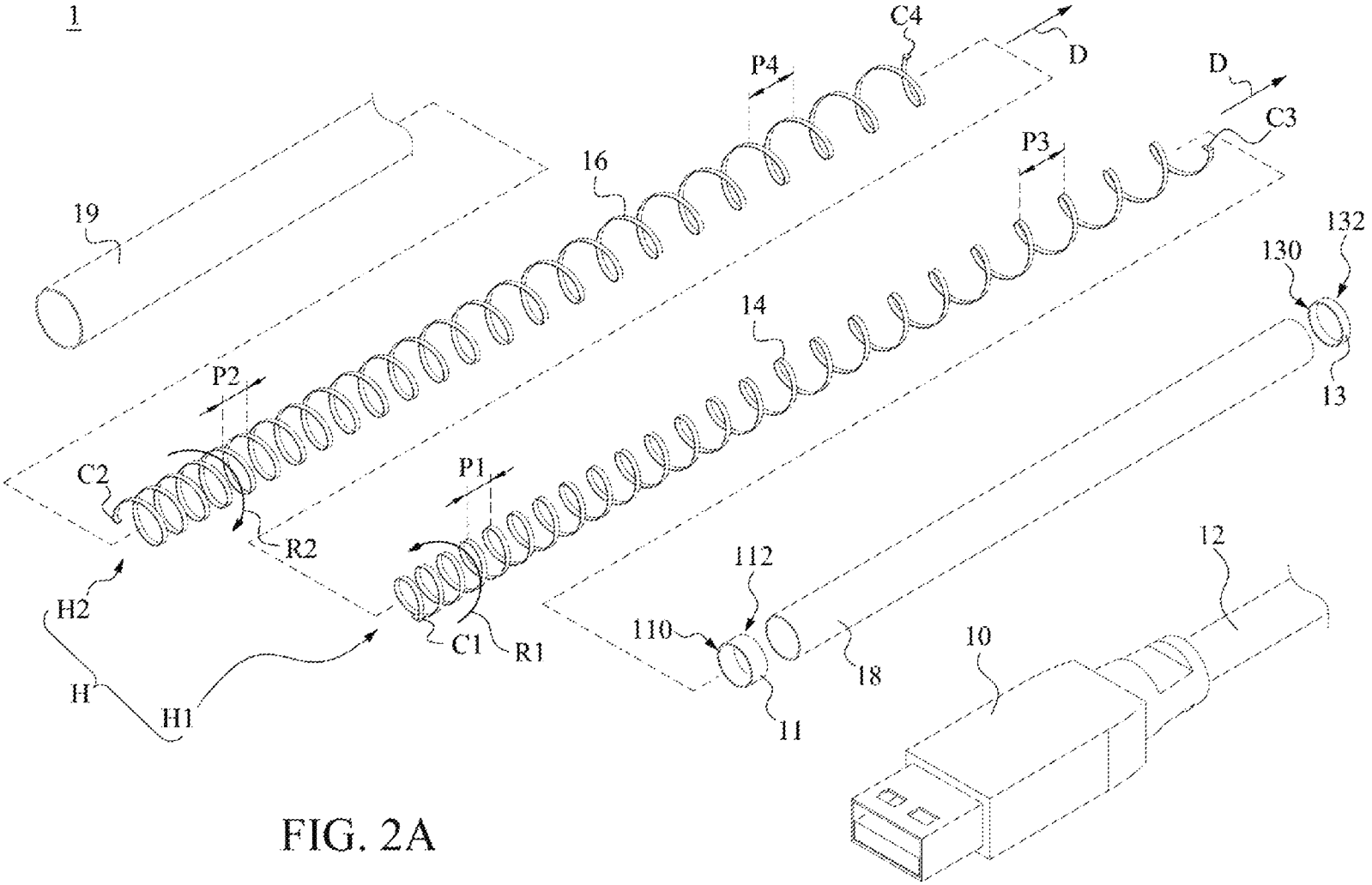
FIG. 2A is an exploded view showing the structure as shown in FIG. 1.
Figure 2B:
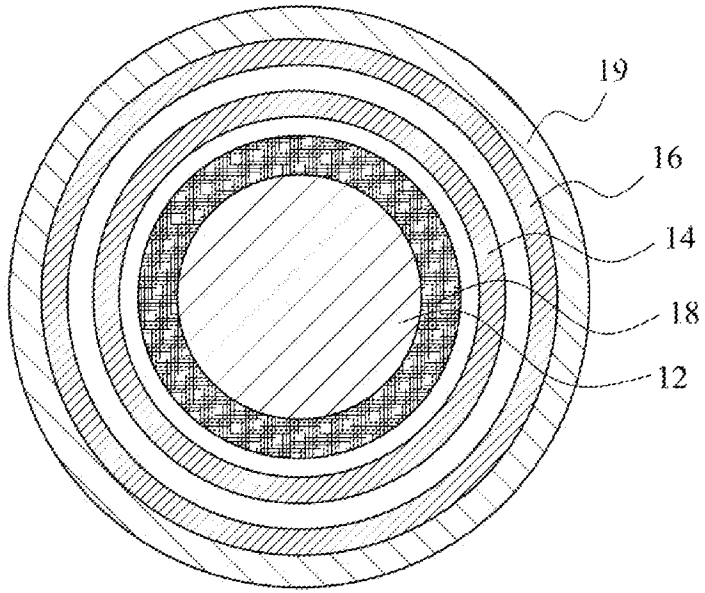
FIG. 2B is a cross-sectional view showing the structure as shown in FIG. 1 along a line segment B-B.

Referring to FIG. 1, FIG. 2A and FIG. 2B, FIG. 1 is a partial three-dimensional view showing a signal transmission cable 1 according to an embodiment of the disclosure, FIG. 2A is an exploded view showing the structure as shown in FIG. 1, and FIG. 2B is a cross-sectional view showing the structure as shown in FIG. 1 along a line segment B-B. As shown in the figures, in this embodiment, the signal transmission cable 1 includes a first connector 10, a signal line 12, a first conductive component 11, a second conductive component 13, a first shielding line 14, a second shielding line 16, a shielding layer 18 (see FIG. 2A and FIG. 2B) and a protective layer 19. In order to more clearly show the disclosure, the protective layer 19 in FIG. 1 is shown by dotted lines, and the shielding layer 18 is omitted.

As shown in FIG. 1, FIG. 2A and FIG. 2B, the signal line 12 is electrically connected to the first connector 10. The signal line 12 extends away from the first connector 10. In some embodiments, the signal line 12 includes at least two circuits (omitted) as round-trip circuits for transmitting power or transmitting signals. In this embodiment, the influence caused by common mode signals is reduced by the configuration of the first shielding line 14 and the second shielding line 16.

In this embodiment, the first conductive component 11 is electrically connected to the first connector 10 and wound around the signal line 12. In this embodiment, the first conductive component 11 has a cylindrical shape and two openings 110, 112 opposite to each other, for being sleeved with the signal line 12. The opening 110 of the first conductive component 11 faces toward the first connector 10, and the opening 112 of the first conductive component 11 faces away from the first connector 10. The signal line 12 extends away from the first connector 10 and passes through the opening 110 and the opening 112 of the first conductive component 11. The common mode current generated by the signal line 12 flows through the first conductive component 11. In some embodiments, the material of the first conductive component 11 includes aluminum (Al), copper (Cu) or any other suitable material. In some embodiments, the structure of the first conductive component 11 is woven by conductive lines.

In this embodiment, the second conductive component 13 is positioned at one side of the shielding layer 18 opposite to the first connector 10, is separated from the shielding layer 18, and wound around the signal line 12. In this embodiment, the second conductive component 13 has a cylindrical shape and two openings 130, 132 opposite to each other, for being sleeved with the signal line 12. The signal line 12 passes through the opening 130 and the opening 132 of the second conductive component 13. The common mode current generated by the signal line 12 flows through the second conductive component 13. In some embodiments, the material of the second conductive component 13 includes aluminum (Al), copper (Cu) or any other suitable material. In some embodiments, the structure of the second conductive component 13 is woven by conductive lines.

As shown in FIG. 2A and FIG. 2B, the shielding layer 18 is positioned between the first shielding line 14 and the signal line 12, wound around the signal line 12, and separated from the first connector 10, the first conductive component 11 and the second conductive component 13 (see FIG. 2A). In some embodiments, the material of the shielding layer 18 includes aluminum (Al), copper (Cu) or any other suitable material. In some embodiments, the structure of the shielding layer 18 is woven by conductive lines.

As shown in FIG. 1 and FIG. 2A, the first shielding line 14 is electrically connected to the first connector 10, extending away from the first connector 10, and wound around the signal line 12 along a first rotating direction R1 (see FIG. 2A). In this embodiment, from the perspective as shown in FIG. 2A, the first rotating direction R1 is counterclockwise wound around the signal line 12 along an extending direction D. That is, the first shielding line 14 is wound around the signal line 12 in a spiral winding mode and covering the signal line 12, to form a first spiral part H1 (see FIG. 2A).

Figure 2D:
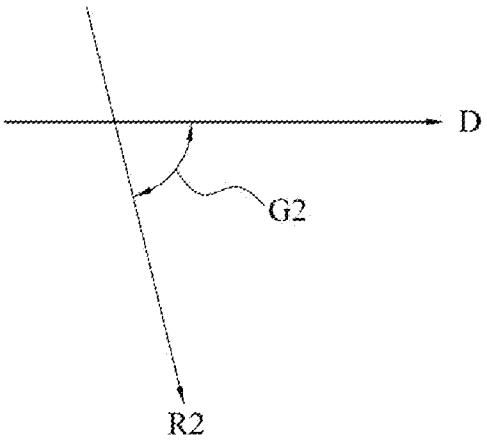
FIG. 2C and FIG. 2D are respectively schematic diagrams showing the relationship between the rotating direction and the extending direction of a shielding line in the structure as shown in FIG. 1.
Figure 2C:
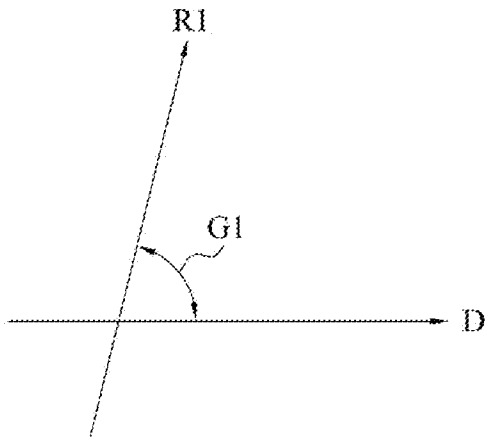

In some embodiments, the length of each of the winding distances of the first shielding line 14 wound around the signal line 12 is the same. In some other embodiments, the length of the winding distances of the first shielding line 14 wound around the signal line 12 is gradually changed. In an embodiment, the lengths of the winding distances of the first shielding line 14 wound around the signal line 12 is gradually increased as the first shielding line 14 extends away from the first connector 10. As shown in FIG. 2A, the portion of the first shielding line 14 close to the first connector 10 has a winding distance P1, the other portion of the first shielding line 14 away from the first connector 10 has a winding distance P3, and the winding distance P3 is greater than the winding distance P1. Therefore, the portion of the signal transmission cable 1 close to the first connector 10 has a good anti-noise effect, and the other portion of the signal transmission cable 1 away from the first connector 10 has a better bending capability so as to enhance the convenience of usage of the signal transmission cable 1. In some embodiments, the first shielding line 14 is tightly wound around the signal line 12 to completely cover the signal line 12. Further, referring to FIG. 2C, FIG. 2C is a schematic diagram showing the relationship between the first rotating direction R1 and the extending direction D of the first shielding line 14 in the structure as shown in FIG. 1. In this embodiment, a first angle G1 formed between the first rotating direction R1 of the first connector 10 and the extending direction D of the first shielding line 14 is within a scope between approximately 60 degrees and approximately 90 degrees.

Further, as shown in FIG. 1 and FIG. 2A, the first shielding line 14 is positioned between the signal line 12 (and the first conductive component 11 and the shielding layer 18) and the second shielding line 16. One end of the first shielding line 14 is electrically connected to a connection point C1 of the first conductive component 11 adjacent to the first connector 10, and the other end of the first shielding line 14 is electrically connected to a connection point C3 of the second conductive component 13. In some embodiments, the first shielding line 14 is covered with an insulating material. In some embodiments, the material of the first shielding line 14 includes copper or any other suitable material. In some embodiments, the size of the first shielding line 14 is applied to different outer diameters of lines. In some embodiments, the first shielding line 14 of the signal transmission cable 1 is connected to the first connector 10 without the first conductive component 11.

As shown in FIG. 1 and FIG. 2A, the second shielding line 16 is electrically connected to the first connector 10, extending away from the first connector 10, and wound around the signal line 12 along a second rotating direction R2 (see FIG. 2A). In an embodiment, from the perspective as shown in FIG. 2A, the second rotating direction R2 is clockwise wound around the signal line 12 along the extending direction D, and is opposite to the first rotating direction R1. That is, the second shielding line 16 is wound around the signal line 12 covering the signal line 12 in a spiral winding mode, to form a second spiral part H2 (see FIG. 2A).

In some embodiments, the lengths of the winding distances of the second shielding line 16 wound around the signal line 12 is the same. In some other embodiments, the lengths of the winding distances of the second shielding line 16 wound around the signal line 12 is gradually changed. In an embodiment, the lengths of the winding distances of the second shielding line 16 wound around the signal line 12 is gradually increased as the second shielding line 16 extends away from the first connector 10. As shown in FIG. 2A, the portion the second shielding line 16 close to the first connector 10 has a winding distance P2, the other portion of the second shielding line 16 away from the first connector 10 has a winding distance P4, and the winding distance P4 is greater than the winding distance P2. Therefore, the portion of the signal transmission cable 1 close to the first connector 10 has a good anti-noise effect, and the other portion of the signal transmission cable 1 away from the first connector 10 has a better bending capability so as to enhance the convenience of the usage of the signal transmission cable 1. In some other embodiments, the second shielding line 16 is tightly wound around the signal line 12 to completely cover the first shielding line 14. Further, referring to FIG. 2D, FIG. 2D is a schematic diagram showing the relationship between the second rotating direction R2 and the extending direction D of the second shielding line 16 in the structure as shown in FIG. 1. In this embodiment, a second angle G2 formed between the second rotating direction R2 of the first connector 10 and the extending direction D of the second shielding line 16 is within a scope between approximately 60 degrees and approximately 90 degrees. In this embodiment, the first shielding line 14 and the second shielding line 16 form a double-spiral structure H.

Further, as shown in FIG. 1 and FIG. 2A, the second shielding line 16 is positioned between the first shielding line 14 and the protective layer 19. One end of the second shielding line 16 is electrically connected to a connection point C2 (see FIG. 2A, omitted in FIG. 1 due to perspective) of the first conductive component 11 adjacent to the first connector 10, and the other end of the second shielding line 16 is electrically connected to a connection point C4 (see FIG. 2A, omitted in FIG. 1 due to perspective) of the second conductive component 13. In this embodiment, the second shielding line 16 is electrically insulated from the first shielding line 14. In an embodiment, the second shielding line 16 is covered with an insulating material. In this embodiment, the connection point C2 of the second shielding line 16 is separated from the connection point C1 of the first shielding line 14. The connection point C4 of the second shielding line 16 is separated from the connection point C3 of the first shielding line 14. In some embodiments, the material of the second shielding line 16 includes copper or any other suitable material. In some embodiments, the size of the second shielding line 16 is applied to different outer diameters of lines.

In this embodiment, the common mode current generated by the signal line 12 flows through the first shielding line 14 and the second shielding line 16 by the first conductive component 11 and/or the second conductive component 13. Because the first shielding line 14 and the second shielding line 16 are two spiral parts with opposite rotating directions, the electromagnetic radiation generated by the common mode current on the first shielding line 14 and the second shielding line 16 substantially eliminates each other so as to inhibit the common mode noise (CM noise) radiation caused by the common mode current. Therefore, the signal transmission cable 1 of this embodiment reduces the influence of the electromagnetic radiation caused by the common mode current on the electronic device so as to maintain the performance (sensitivity and throughput) of the RF component in the device.

In an embodiment, the signal transmission cable 1 supports USB3.0. Further, in a test of receiving sensitivity, based on the frequency use scope of some signal transmission cables 1, compared with a signal transmission cable without a double-spiral structure H (see FIG. 2A), the receiving sensitivity of the signal transmission cable 1 is improved by at least 10 dB.

As shown in FIG. 1, FIG. 2A and FIG. 2B, the protective layer 19 is covering the second shielding line 16 and is insulated from the first connector 10, the shielding layer 18, the first shielding line 14, and the second shielding line 16. In an embodiment, the second shielding line 16 is covered in the insulating material, and the protective layer 19 covers the second shielding line 16 and contacts the insulating material so as to be insulated from the second shielding line 16. In this embodiment, the protective layer 19 in the signal transmission cable 1 is floating so as to shield the interference of the electromagnetic radiation on the signal transmission cable 1 in the external environment. In some embodiments, the material of the protective layer 19 is a conductive material. In an embodiment, the material of the protective layer 19 includes aluminum, copper or any other suitable material.

Figure 3:
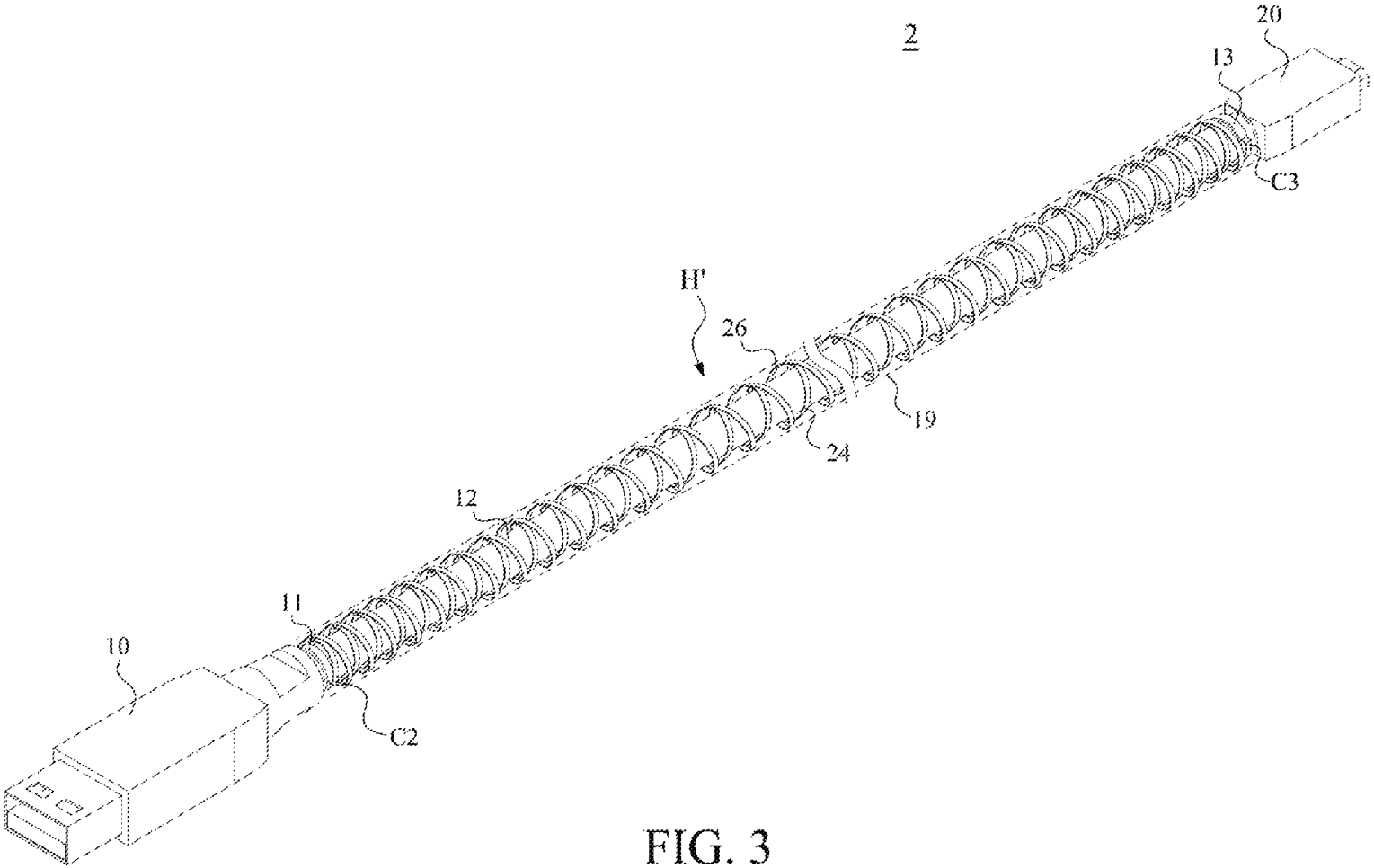
FIG. 3 is a partial three-dimensional view showing a signal transmission cable according to another embodiment of the disclosure.

Referring to FIG. 3, FIG. 3 is a partial three-dimensional view showing a signal transmission cable 2 according to another embodiment of the disclosure. As shown in FIG. 3, in this embodiment, the signal transmission cable 2 includes a first connector 10, a second connector 20, a first conductive component 11, a second conductive component 13, a signal line 12, a shielding layer (referring to same component in FIG. 2A), a first shielding line 24, a second shielding line 26 and a protective layer 19. In order to more clearly show the disclosure, the protective layer 19 in FIG. 3 is shown by dotted lines, and the shielding layer is omitted.

It should be noted that the difference between this embodiment and the embodiments as shown in FIG. 1 to FIG. 2B is that this embodiment further includes the second connector 20. The signal line 12 is electrically connected between the first connector 10 and the second connector 20. Further, the second conductive component 13 is electrically connected to the second connector 20 and is wound around the signal line 12. In addition, compared to the signal transmission cable 1 as shown in FIG. 1, the first shielding line 24, the second shielding line 26 and the shielding layer extend from the first connector 10 to the second conductive component 13. And, the first shielding line 24, the second shielding line 26 and the shielding layer are connected to the second connector 20 through the second conductive component 13. In this embodiment, the first shielding line 24 and the second shielding line 26 form a double-spiral structure H'.

Because the first shielding line 24 and the second shielding line 26 are two spiral parts with opposite rotating directions of the double-spiral structure H', the electromagnetic radiation generated by the common mode current flowing in the first shielding line 24 and the second shielding line 26 substantially eliminates each other so as to inhibit the CM noise between the first connector 10 and the second connector 20 due to the common mode current.

The detailed descriptions of the specific embodiments of the disclosure obviously show that because the first shielding line and the second shielding line of the disclosure are two spiral parts with opposite rotating directions and jointly form the double-spiral structure, the electromagnetic radiation generated by the common mode current flowing in the first shielding line and the second shielding line substantially eliminates each other so as to inhibit the CM noise caused by the common mode current. Therefore, the signal transmission cable of this embodiment reduces the influence of the electromagnetic radiation caused by the common mode current on the electronic device.

The features of the foregoing embodiments provide those of ordinary skill in the art with a better understanding of the aspects of the disclosure. It will be appreciated by those of ordinary skill in the art that to achieve the same objectives and/or the advantages of the embodiments described herein, other processes and structures may be further designed or modified readily based on the disclosure. It will be appreciated by those of ordinary skill in the art that such equivalent structures do not depart from the spirit and scope of the disclosure, and various changes, replacements, and modifications may be made without departing from the spirit and scope of the disclosure.

What is claimed is:

1. A signal transmission cable, comprising:

a first connector;

a signal line, electrically connected to the first connector;

a conductive element, sleeved with the signal line, and electrically connected to the first connector;

a first shielding line in contact with a first connection point on the conductive element, extending away from the first connector, and wound around at least a portion of the signal line along a first rotating direction; and a second shielding line in contact with a second connection point on the conductive element that is spaced apart from the first connection point, extending away from the first connector, and winds around at least a portion of the signal line along a second rotating direction.

2. The signal transmission cable according to claim 1, wherein the first shielding line and the second shielding line jointly form a double-spiral structure.

3. The signal transmission cable according to claim 1, wherein the first shielding line is positioned between the signal line and the second shielding line.

4. The signal transmission cable according to claim 1, wherein the first shielding line is connected to a first connection point on the first connector, the second shielding line is connected to a second connection point on the first connector, and the second connection point is separated from the first connection point.

5. The signal transmission cable according to claim 1, further comprising a shielding layer, positioned between the first shielding line and the signal line.

6. The signal transmission cable according to claim 5, wherein the shielding layer is separated from the first connector.

7. The signal transmission cable according to claim 1, further comprising a protective layer which is covering and is insulated from the first shielding line and the second shielding line.

8. The signal transmission cable according to claim 1, further comprising a second connector, wherein the signal line, the first shielding line and the second shielding line are electrically connected between the first connector and the second connector respectively.

9. The signal transmission cable according to claim 1, wherein the first shielding line wound around the signal line has a first winding distance, the second shielding line wound around the signal line has a second winding distance, and at least one of the first winding distance and the second winding distance is not a constant value.

* * * * *